US007029331B1

(12) United States Patent
Lai

(10) Patent No.: US 7,029,331 B1
(45) Date of Patent: Apr. 18, 2006

(54) SHIELD AND CONNECTOR WITH THE SHIELD

(75) Inventor: Ming Chun Lai, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/060,534

(22) Filed: Feb. 18, 2005

(51) Int. Cl.
*H01R 13/648* (2006.01)

(52) U.S. Cl. ..... 439/609; 439/939

(58) Field of Classification Search ..... 439/609, 439/939, 607, 608, 610
See application file for complete search history.

(56) References Cited

U.S. PATENT DOCUMENTS 5,178,562 A * 1/1993 Ermini ..... 439/609
5,637,014 A * 6/1997 Sukegawa et al. ..... 439/607
5,755,595 A * 5/1998 Davis et al. ..... 439/607
5,975,957 A * 11/1999 Noda et al. ..... 439/609
6,050,854 A * 4/2000 Fang et al. ..... 439/607
6,168,448 B1 * 1/2001 Chang ..... 439/188
6,343,956 B1 * 2/2002 Stickney ..... 439/609
6,533,612 B1 * 3/2003 Lee et al. ..... 439/607
6,764,339 B1 * 7/2004 Kubo ..... 439/607
6,814,592 B1 * 11/2004 Stahl ..... 439/108
6,932,614 B1 * 8/2005 Kan ..... 439/580
6,943,287 B1 * 9/2005 Lloyd et al. ..... 174/35 GC
6,962,511 B1 * 11/2005 Gutierrez et al. ..... 439/676

* cited by examiner

*Primary Examiner*—Gary F. Paumen
(74) *Attorney, Agent, or Firm*—Rosenberg, Klein & Lee

(57) ABSTRACT

The present invention provides a shield and a connector with the shield. The shield includes a top surface, a bottom surface and two lateral surfaces to receive the connector. A plurality of first cantilever elastic slices is formed at the top and lateral surfaces of the shield. A second cantilever elastic slice is formed at the top surface of the shield. The second cantilever elastic slice is longitudinally incised to form two slots. A simple supporting beam is formed between the two slots. The simple supporting beam projects and props a mated connector. The received connector further includes a plastic casing. The plastic casing inserts into the shield and receives a plurality of contacts. So that the reliable and steady insertion function between the shield and the connector is obtained, the integral and continuous shielding function of the shield is achieved too.

8 Claims, 3 Drawing Sheets

SHIELD AND CONNECTOR WITH THE SHIELD

BACKGROUND OF THE INVENTION

1. Field of the Invention

The present invention relates to a shield and a connector with the shield, and more especially to a shield and a connector with the shield, which has an integral and continuous shielding function and a reliable and steady propping function between the shield and the mated connector.

2. The Related Art

For reducing electromagnetic interference of connectors, a most common method is to provide metal shields enclosing male and female connectors and allowing the shields communicational and grounding in order to prevent electromagnetic interference of the male and female connectors.

In general, the shield of the male connector is incised and bended to form a cantilever elastic slice; a cutout is designed in the shield of the female connector corresponding the cantilever elastic slice. The cantilever elastic slice extends and downwardly props the cutout to make the two shields tightly prop each other when the male connector inserts into the female connector. So that the fixation and cooperation function between the male and female connector is achieved, the communication and grounding function between the two shields is achieved too.

The rigidity of the cantilever elastic slice is weaker, so that it is difficulty to achieve a steady propping function between the two shields. It is impossible to achieve the reliable insertion between the male and female connectors, the indeed communication and grounding between the two shields. When a plurality of cantilever elastic slices is set at the top surface, the bottom surface and the two lateral surfaces of the shield, the steady propping function between the two shields is achieved. But large hollow area is formed at each surface of the shield; the integrity of the shield is seriously damaged. Then the integrity and continuity of the shielding is difficulty to achieved.

SUMMARY OF THE INVENTION

An object of the invention is to provide a shield for reducing electromagnetic interference of connectors. The shield comprises a top surface, a bottom surface and two lateral surfaces to provide an insertion room in which a connector is received. A plurality of first cantilever elastic slices is formed at the top and lateral surfaces of the shield. A second cantilever elastic slice is formed at the top surface of the shield. The second cantilever elastic slice is arranged between the first cantilever elastic slices at the top surface of the shield. A pair of slots is formed on the second cantilever elastic slice. A simple supporting beam is formed between the two slots. The simple supporting beam projects and props a shield of a mated connector. The shield achieves an integral and continuous shielding function, a reliable and steady propping function between the shield and the mated connector.

Another object of the invention is to provide a connector with the shield. According to the present invention, the connector includes a plastic casing which inserts into the shield and receives a plurality of contacts. The connector with the shield achieves an integral and continuous electromagnetic shielding function and a reliable and steady insertion function between the connector and the mated connector.

According to the invention, the simple supporting beam tightly props the shield of the mated connector. The second cantilever elastic slice has well elasticity and automatically adjusts the propping force between the simple supporting beam and the shield, so that the simple supporting beam always credibly and steadily props the shield without damage of the shield. Then, a reliable insertion and cooperation function between the two connectors is achieved. An indeed communication and grounding function between the two shields is achieved too. The first cantilever elastic slices and second cantilever elastic slice are all set in the front of the shield. There is no large hollow area formed at the surface of the shield. So that the integrality of the shield is not damaged, the integral and continuous shielding function of the shield is achieved.

DETAILED DESCRIPTION OF THE PREFERRED EMBODIMENT

The present invention will now be described with respect to the accompanying drawings in which like numbered elements represent like parts.

Figure 1:
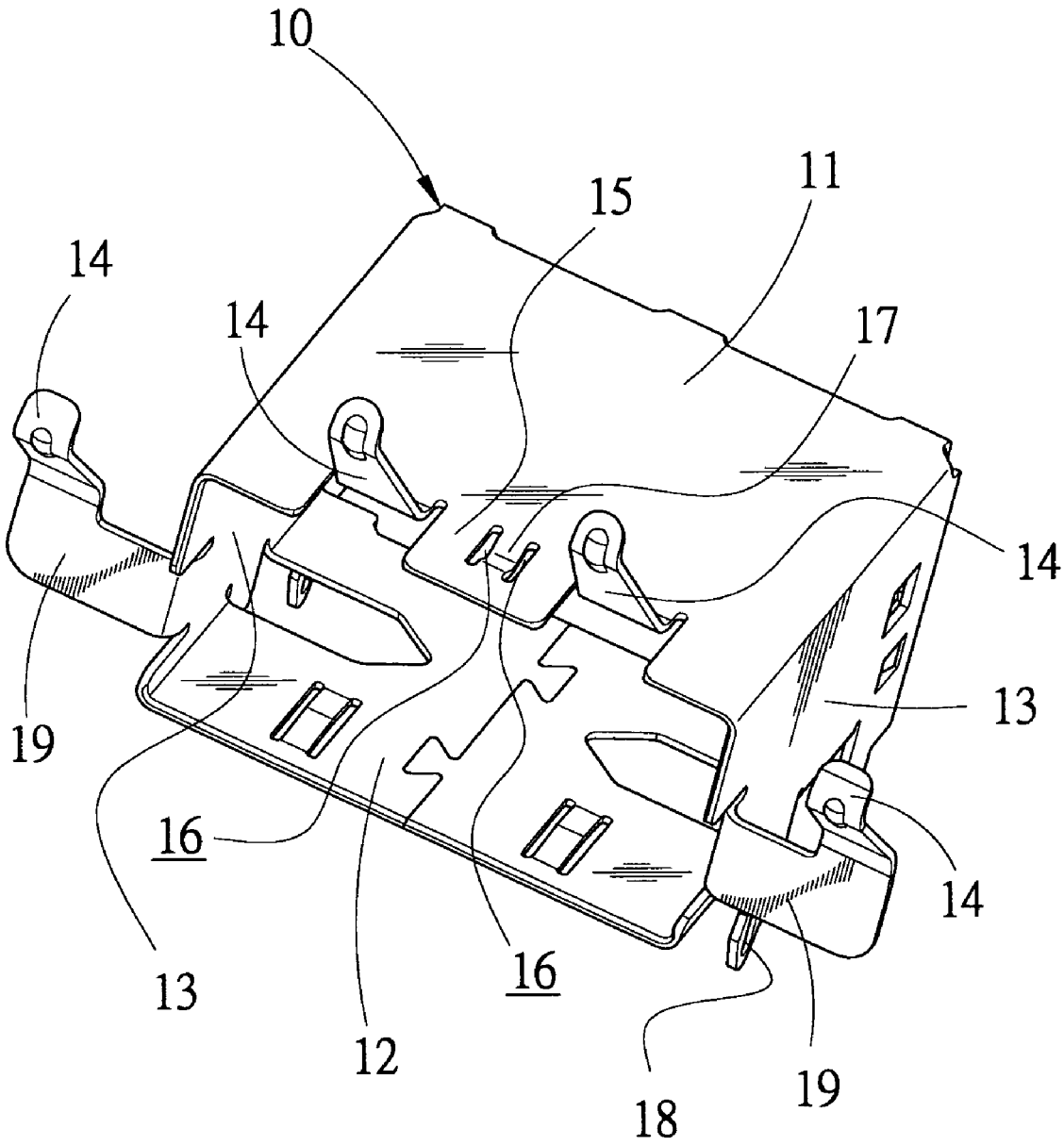
FIG. 1 is a perspective view of a shield in according with the present invention.
Figure 3:
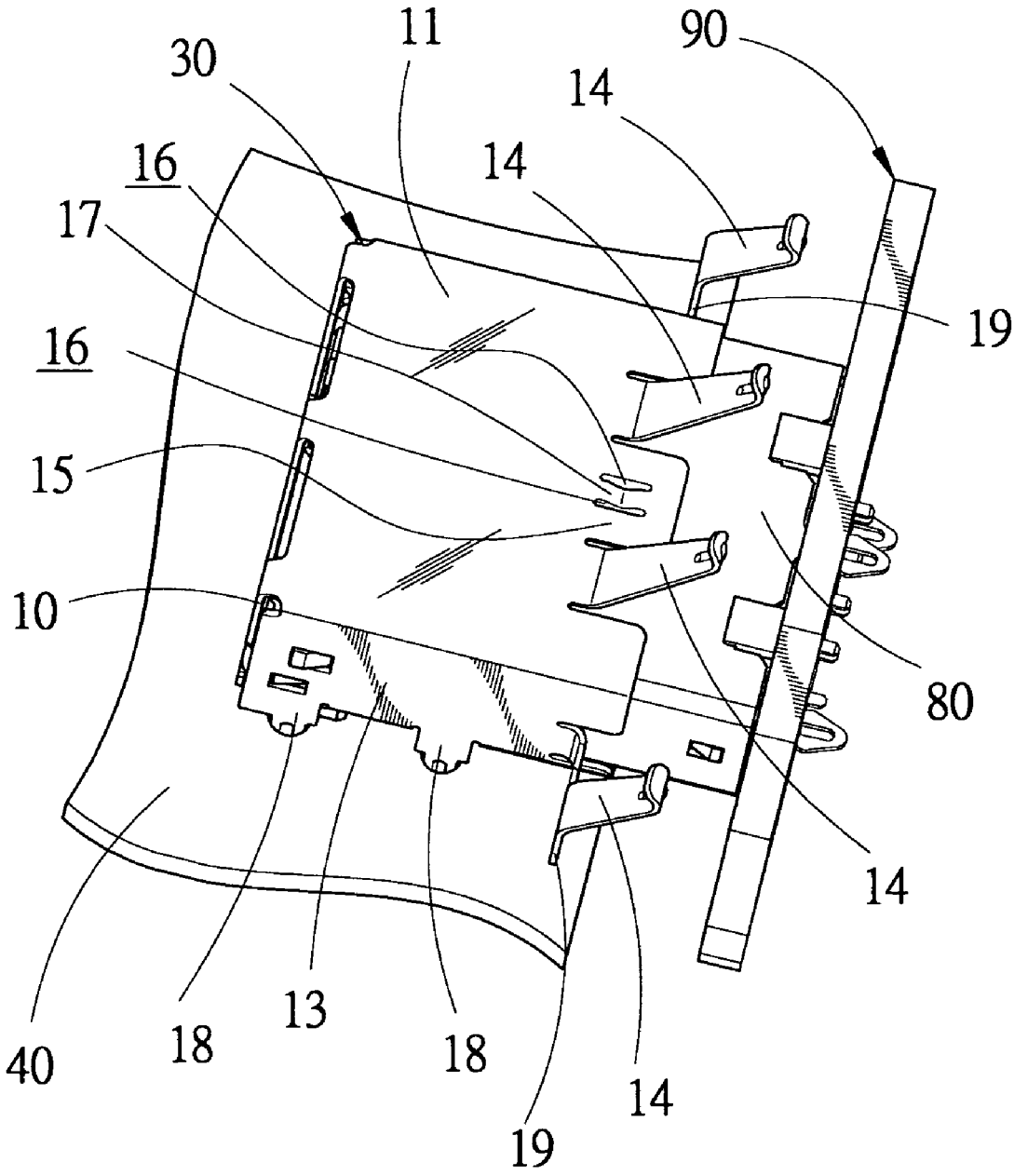
FIG. 3 is a perspective view showing a mated connector inserting into the connector in according with the present invention.

With reference to FIGS. 1 and 3, a shield 10 of the present invention is a rectangular block section in which a connector 30 is received. The shield 10 comprises a top surface 11, a bottom surface 12 and two lateral surfaces 13. The surfaces 11, 12 and 13 and the connector 30 provide an insertion room into which a shield 80 of a connector 90 inserts.

There are a plurality of first cantilever elastic slices 14 formed at the top and lateral surfaces of the shield 10. A second cantilever elastic slice 15 is formed at the top surface of the shield 10. The second cantilever elastic slice 15 is arranged between the first cantilever elastic slices 14 at the top surface of the shield 10. The second cantilever elastic slice 15 is longitudinally incised to form two slots 16. A simple supporting beam 17 is formed between the two slots 16. The simple supporting beam 17 projects and props the shield 80 of the mated connector 90.

A plurality of orientation patches 18 downwardly projects from the lateral surfaces 13 of the shield 10. The orientation patches 18 pass through and are welded in a circuit board 40 so that the shield 10 is under grounding state. A tongue patch 19 outwardly projects from each lateral surface 13 of the shield 10 separately. The free end of the tongue patch 19 bends up and extends a first cantilever elastic slice 14. The first cantilever elastic slice 14 props and communicates with an iron shell (not shown), which is an outer apparatus for receiving the connector 30. Then the reliable and steady grounding function of the shield 10 is better obtained.

As illustrated above, the simple supporting beam 17 tightly props the shield 80 of the mated connector 90. The second cantilever elastic slice 15 has well elasticity and automatically adjusts the propping force between the simple supporting beam 17 and the shield 80, so that the simple supporting beam 17 always credibly and steadily props the shield 80 without damage of the shield 80. Then a reliable insertion and cooperation function between the connector 30 and 90 is achieved. An indeed communication and grounding function between the shield 10 and 80 is achieved too. Although, the shield 10 has a plurality of first cantilever elastic slices 14 and the second cantilever elastic slice 15, the first cantilever elastic slices 14 and the second cantilever elastic slice 15 are all set in the front of the shield 10. There is no large hollow area formed at the surface of the shield 10. So that the integrality of the shield 10 is not damaged, the integral and continuous shielding function of the shield 10 is achieved.

Figure 2:
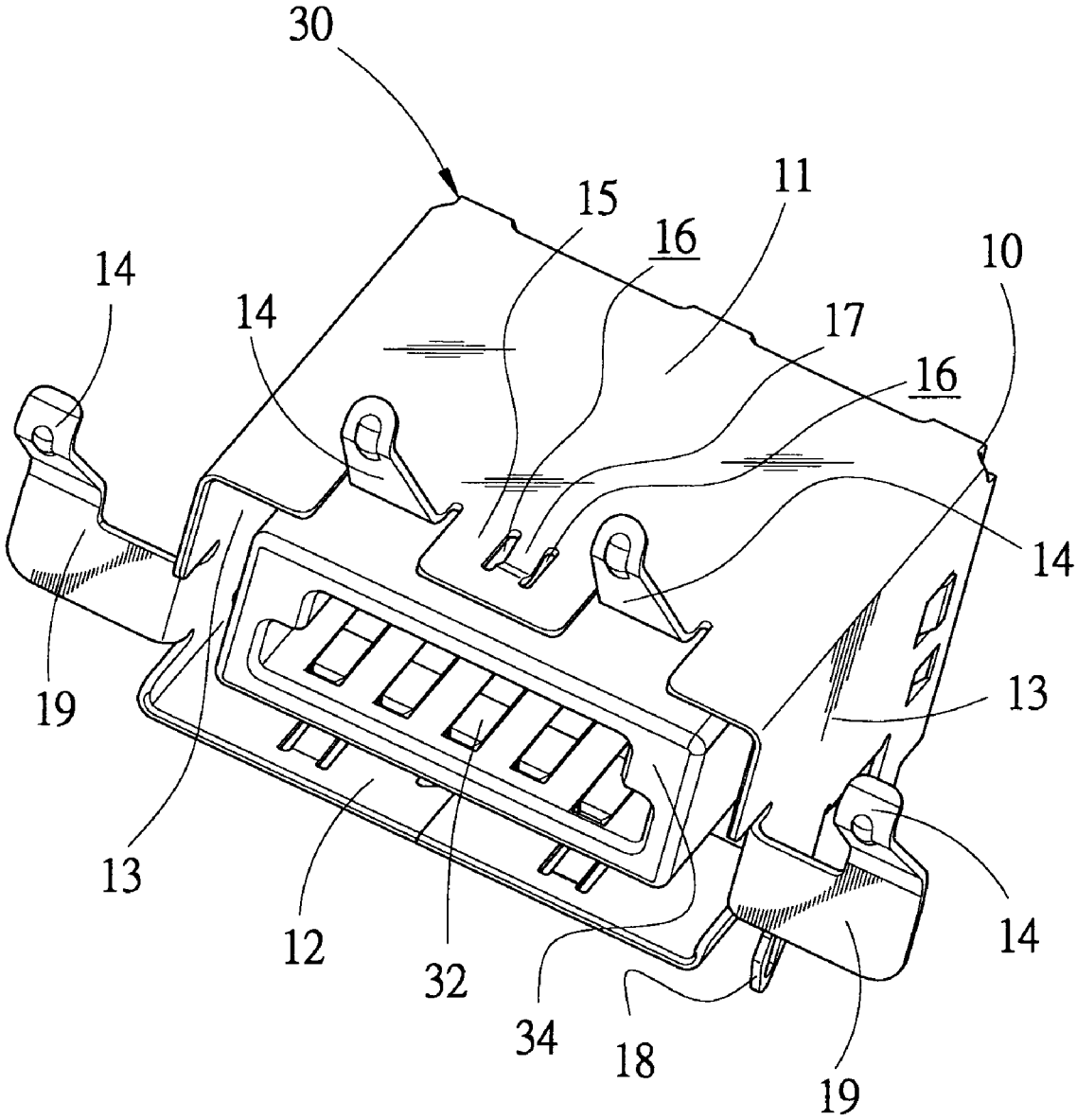
FIG. 2 is a perspective view of a connector in according with the present invention.

In FIGS. 2 and 3, the connector 30 of the invention is shown, which has a shield. The connector 30 includes the shield 10 and a plastic casing 34. The plastic casing 34 inserts into the shield 10 and receives a plurality of contacts 32. As illustrated above, there is an incorporate design between the second cantilever elastic slice 15 and the simple supporting beam 17 in the shield 10. So that the reliable and steady insertion function between the shield 10 and the connector 90 is obtained, the integral and continuous shielding function of the shield 10 is achieved too.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A shield assembled with a received connector, the shield comprising:

a top surface, a bottom surface and two lateral surfaces to provide an insertion room in which a connector is received;

a plurality of first cantilever elastic slices formed at the top and lateral surfaces of the shield;

a second cantilever elastic slice formed at the top surface of the shield, the second cantilever elastic slice arranged between the first cantilever elastic slices at the top surface of the shield;

a pair of slots formed on the second cantilever elastic slice;

a simple supporting beam formed between the two slots, the simple supporting beam projecting toward and engaging a shield of a mated connector.

2. The shield according to claim 1, wherein the simple supporting beam extends towards the inside of the shield.

3. The shield according to claim 1, wherein the simple supporting beam extends towards the outside of the shield.

4. The shield according to claim 1, wherein the second cantilever elastic slice is longitudinally incised to form the two slots.

5. The shield according to claim 1, wherein the top surface is incised to form two elastic slices; the free end of each elastic slice bends up to form a first cantilever elastic slice.

6. The shield according to claim 1 further comprising a plurality of orientation patches downwardly projecting from the lateral surfaces.

7. The shield according to claim 1 further comprising a tongue patch outwardly projecting from each lateral surface separately; the free end of the tongue patch having a first cantilever elastic slice extending upwardly therefrom.

8. The shield according to claim 1, wherein the received connector has a plastic casing which receives a plurality of contacts.

* * * * *